US012220065B2

(12) United States Patent
Chen et al.

(10) Patent No.: US 12,220,065 B2
(45) Date of Patent: Feb. 11, 2025

(54) FOLDING CHAIR

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 152 days.

(21) Appl. No.: 18/113,627

(22) Filed: Feb. 24, 2023

(65) Prior Publication Data

US 2023/0270253 A1 Aug. 31, 2023

(30) Foreign Application Priority Data

Feb. 28, 2022 (CN) ..... 202220417064.1

(51) Int. Cl.
*A45F 3/26* (2006.01)
*A47C 4/42* (2006.01)

(52) U.S. Cl.
CPC ..... *A47C 4/42* (2013.01)

(58) Field of Classification Search
CPC ..... A45F 3/26
USPC ..... 297/276, 281, 282
See application file for complete search history.

(56) References Cited

U.S. PATENT DOCUMENTS 11,547,201 B1 * 1/2023 Sun ..... A47C 3/026
2023/0165373 A1 * 6/2023 Chen ..... A45F 3/26 297/19
2024/0306819 A1 * 9/2024 Chen ..... A47C 4/30

FOREIGN PATENT DOCUMENTS

CN 108260976 A 7/2018
CN 113907549 A 1/2022

* cited by examiner

*Primary Examiner* — Rodney B White
(74) *Attorney, Agent, or Firm* — Bayramoglu Law Offices LLC

(57) ABSTRACT

A folding chair includes two standing posts, two diagonal bracing mechanisms, and a linkage mechanism, where the linkage mechanism includes two linkage posts that are crossed and hinged with each other. The diagonal bracing mechanisms each include two diagonal braces, two under-frame posts, a first connector, and a second connector. The upper ends of the two diagonal braces and an upper end of one linkage post are hinged with the first connector, and the lower ends of the two diagonal braces are respectively hinged with the first ends of the two under-frame posts. The second ends of the two under-frame posts and the lower end of the linkage post are hinged with the second connector. The two standing posts are respectively connected to two first connectors and respectively limit the positions of the two first connectors.

13 Claims, 4 Drawing Sheets

FOLDING CHAIR

CROSS REFERENCE TO THE RELATED APPLICATIONS

This application claims priority based on Chinese patent application No. 202220417064.1 filed on Feb. 28, 2022, the entire contents of which are hereby incorporated by reference.

TECHNICAL FIELD

The present application relates to the technical field of outdoor chairs, and in particular to a folding chair.

BACKGROUND

Folding chairs are popular with outdoor users because they are foldable and portable. Chinese patent application CN108260976A provides a folding chair and a folding support thereof. In the folding chair, the bottoms of the standing posts are hinged to the chair's body. The standing posts need a sufficient length to prevent their upper ends from being separated from the sliding sleeve when the folding chair is folded, which to some extent limits the height of the folding chair in the unfolded state. Due to a large aspect ratio, the folding chair is unstable and prone to fall over when used on soft ground surfaces such as sandy beaches and muddy roads. In addition, the standing posts are too high, which is not convenient for the user to get up using their hands supported on the standing posts.

SUMMARY

The technical problem to be solved by the present application is to change the aspect ratio of the folding chair in the prior art to make it more stable and foldable when used on a soft ground surface. To this end, the present application provides a folding chair.

To solve the technical problem, the present application adopts the following technical solution. A folding chair includes two standing posts, two diagonal bracing mechanisms, and a linkage mechanism connected between the two diagonal bracing mechanisms.

The linkage mechanism includes two linkage posts that are crossed and hinged with each other.

The diagonal bracing mechanisms each include two diagonal braces, two under-frame posts, a first connector, and a second connector. The upper ends of the two diagonal braces and an upper end of one linkage post are hinged with the first connector, and the lower ends of the two diagonal braces are respectively hinged with the first ends of the two under-frame posts; second ends of the two under-frame posts and a lower end of the linkage post are hinged with the second connector.

The two standing posts are respectively connected to two first connectors and respectively limit positions of the two first connectors.

The lower ends of the two standing posts are detachably fixed to the linkage mechanism or are respectively detachably fixed to the two diagonal bracing mechanisms.

Preferably, the second connector is provided with a first socket, and the lower end of the standing post is inserted into the first socket.

Preferably, the folding chair further includes two third connectors. The two third connectors are respectively fixed to the two linkage posts, and each is provided with a second socket. The lower end of the standing post is inserted into the second socket.

Preferably, the first connector is slidably sleeved on the standing post.

Preferably, the standing post is provided with a pressing portion. When the folding chair is unfolded, the pressing portion can press the first connector.

Preferably, the third connectors each include a main body, a lock key, a press key, a spring, and a cover. The main body is provided with the second socket and a receiving slot. The lock key is provided in the receiving slot and includes a head inserted into the second socket from a side; the cover covers the receiving slot. The press key is provided on the cover and is in sliding fit with the cover. The lock key includes a post portion connected to the head and provided thereon with a retaining ring. The spring is sleeved on the post portion and includes two ends pressed against the retaining ring and the cover, respectively.

The lock key is provided with a first inclined plane, and the press key is provided with a second inclined plane opposite to the first inclined plane. The lower end of the standing post is provided with a clamping opening.

When the standing post is inserted into the second socket, the head of the lock key is embedded into the clamping opening.

When the press key is pressed, the second inclined plane presses the first inclined plane, such that the head of the lock key is separated from the clamping opening.

Preferably, the folding chair further includes a cushion; two sides of the cushion are respectively connected to hanging straps; the standing posts are respectively connected to the hanging straps through fourth connectors to support the hanging straps.

Preferably, the diagonal bracing mechanisms each further include two support bases; the lower ends of the diagonal braces and the first ends of the under-frame posts are respectively hinged with the support bases.

Preferably, each of the diagonal bracing mechanisms further includes two base plates; the lower ends of the diagonal braces are respectively hinged with the base plates. The first ends of the under-frame posts are respectively hinged with the diagonal braces.

The present application has the following beneficial effects. The folding chair changes the length and connecting structure of the standing posts, thereby reducing the aspect ratio. The folding chair is foldable and portable, is more stable, and does not easily fall over when used on a soft ground surface.

BRIEF DESCRIPTION OF THE DRAWINGS

The present application is described in further detail below by referring to the drawings and embodiments.

Figure 1:
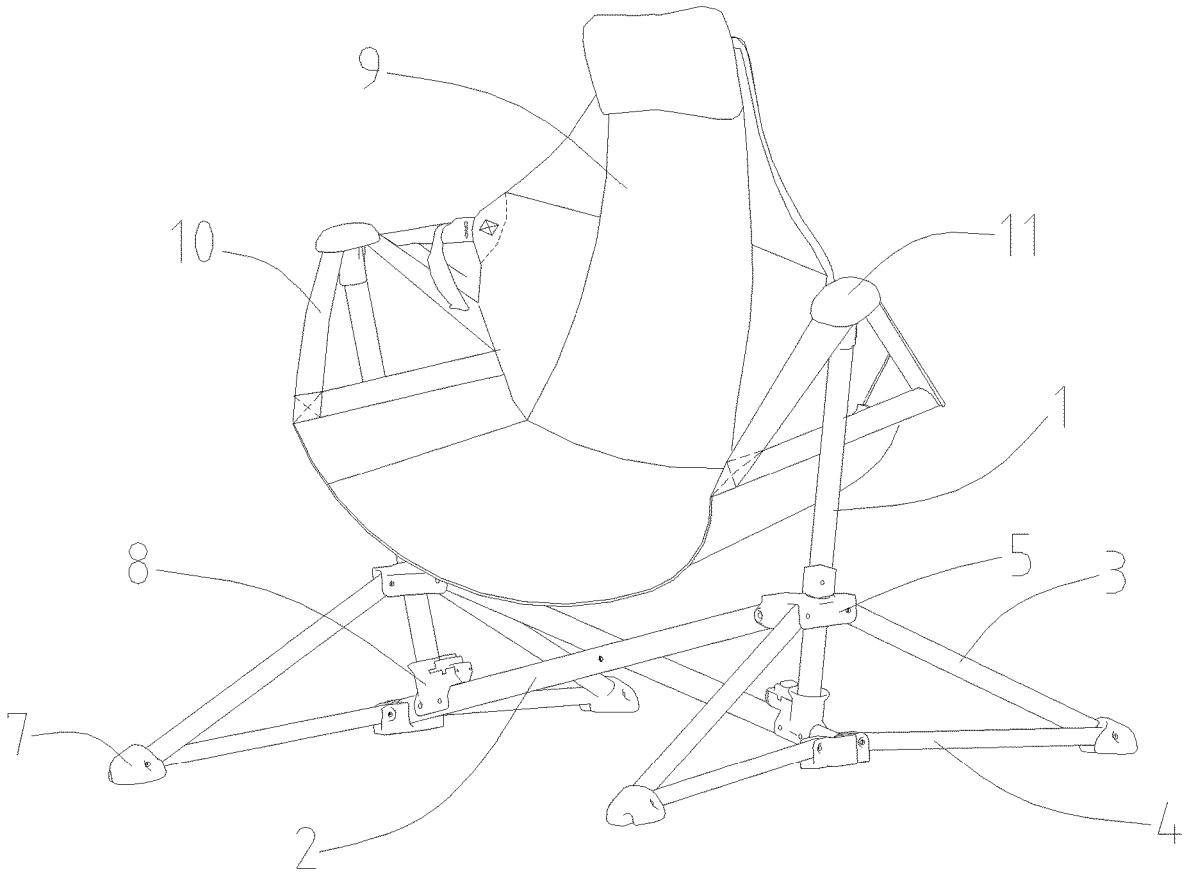
FIG. 1 is a structural diagram of an embodiment of a folding chair according to the present application.
Figure 2:
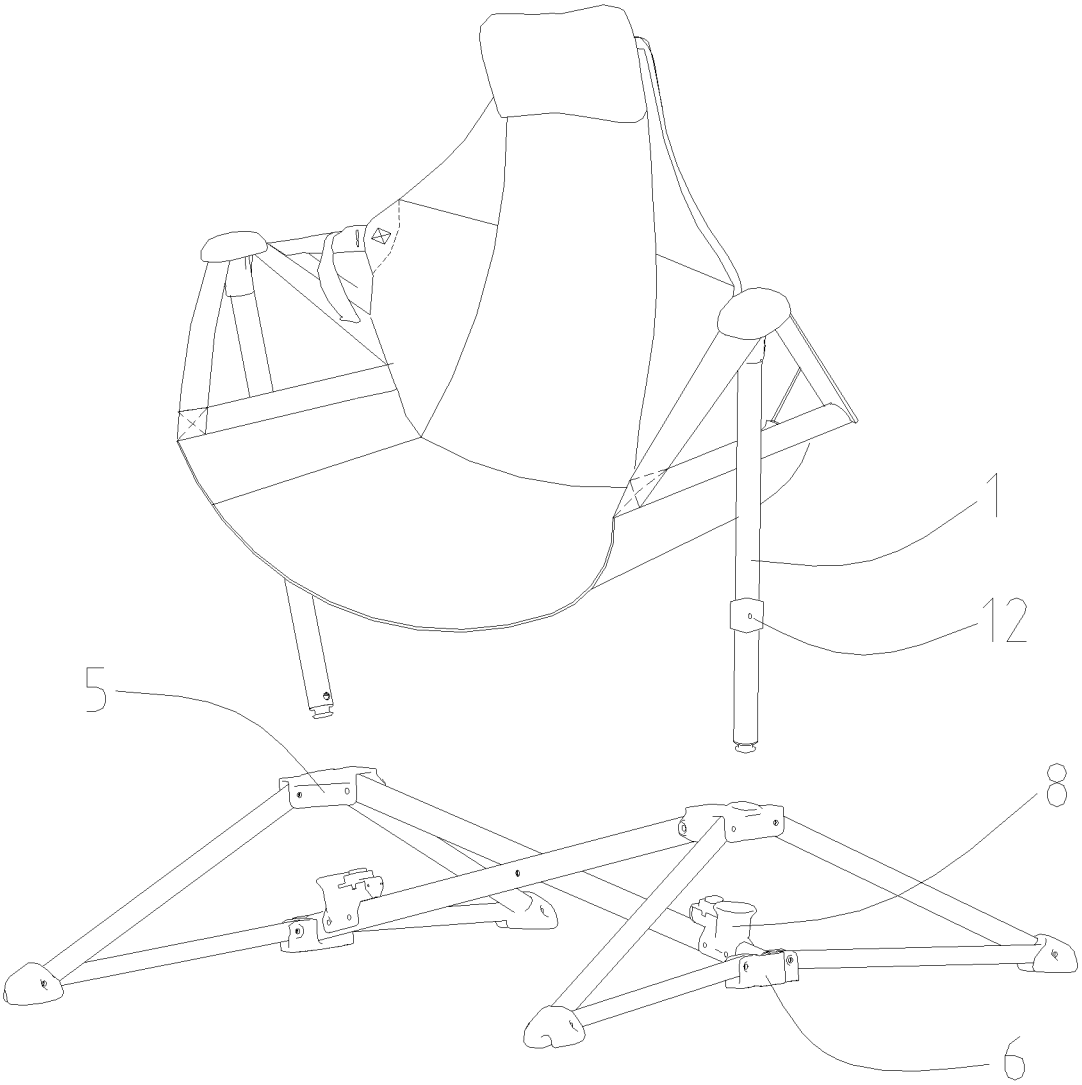
FIG. 2 is a structural diagram of the embodiment of the folding chair in a disassembled state according to the present application.
Figure 3:
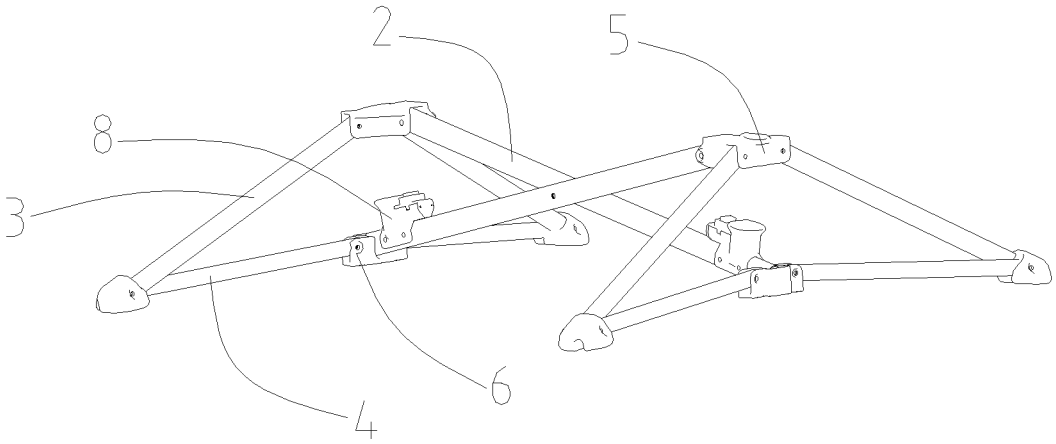
FIG. 3 is a structural diagram of a bottom support structure of the embodiment of the folding chair in an unfolded state according to the present application.
Figure 4:
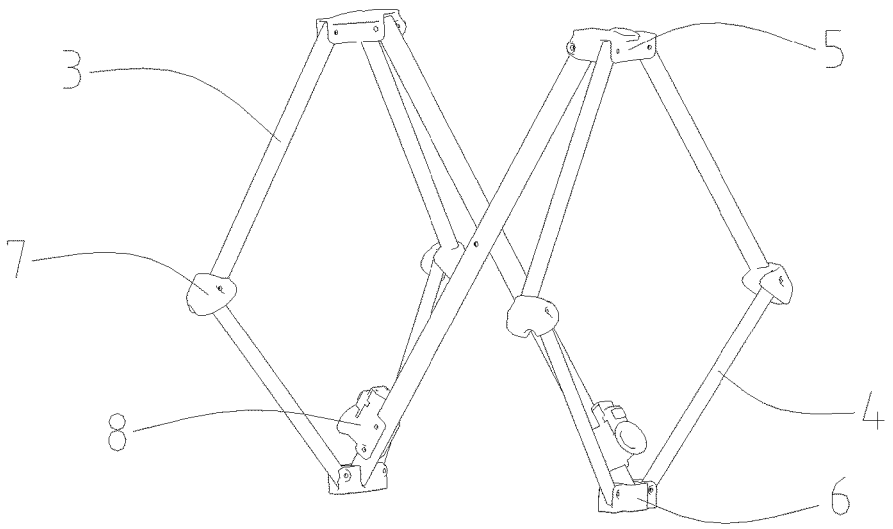
FIG. 4 is a structural diagram of the bottom support structure of the embodiment of the folding chair in a half-folded state according to the present application.

Reference Numerals: 1. standing post; 2. linkage post; 3. diagonal brace; 4. under-frame post; 5. first connector; 6. second connector; 7. support base; 8. third connector; 9. cushion; 10. hanging strap; 11. fourth connector; 12. pressing portion; 100. first inclined plane; 200. second inclined plane; 801. main body; 802. lock key; 803. press key; 804. spring; 805. cover; 806. second socket; 807. receiving slot; 808. post portion; 809. retaining ring.

DETAILED DESCRIPTION OF THE EMBODIMENTS

The embodiments of the present application are described below in detail. The embodiments are shown in the drawings. The same or similar numerals represent the same or similar elements or elements having the same or similar functions throughout the specification. The embodiments described below by referring to the drawings are exemplary and are merely intended to explain the present application, rather than to limit the present application.

As shown in FIGS. 1 to 4, the present application provides an embodiment of a folding chair. The folding chair includes two standing posts 1, two diagonal bracing mechanisms, and a linkage mechanism connected between the two diagonal bracing mechanisms. The linkage mechanism includes two linkage posts 2 that are crossed and hinged with each other. The diagonal bracing mechanisms each include two diagonal braces 3, two under-frame posts 4, a first connector 5, and a second connector 6. The upper ends of the two diagonal braces 3 and an upper end of one linkage post 2 are hinged with the first connector 5, and the lower ends of the two diagonal braces 3 are respectively hinged with the first ends of the two under-frame posts 4 on support base 7. The second ends of the two under-frame posts 4 and the lower end of the linkage post 2 are hinged with the second connector 6. The diagonal bracing mechanisms and the linkage mechanism form a foldable bottom support structure.

Figure 5:
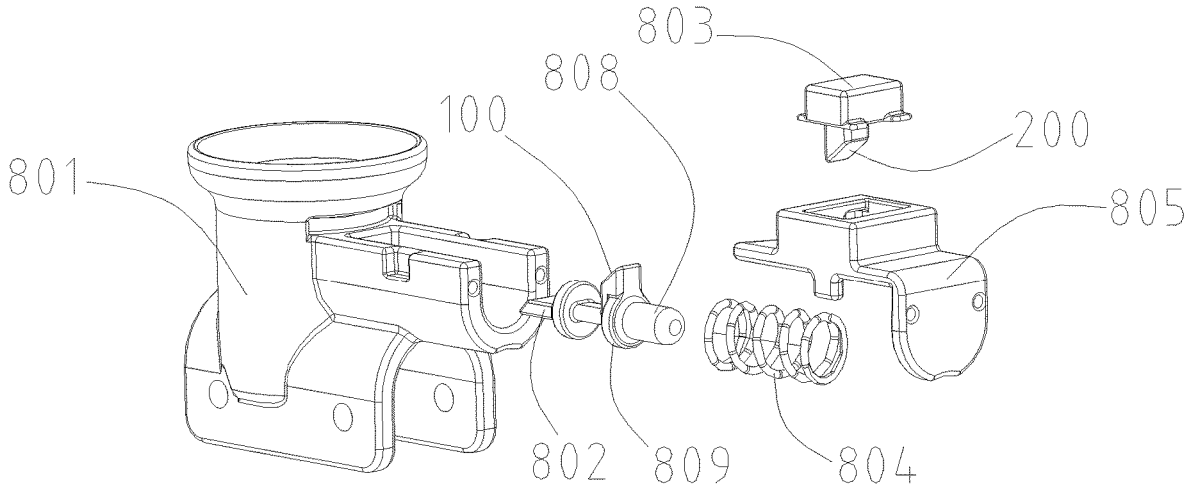
FIG. 5 is an exploded view of a third connector of the embodiment of the folding chair according to the present application.
Figure 6:
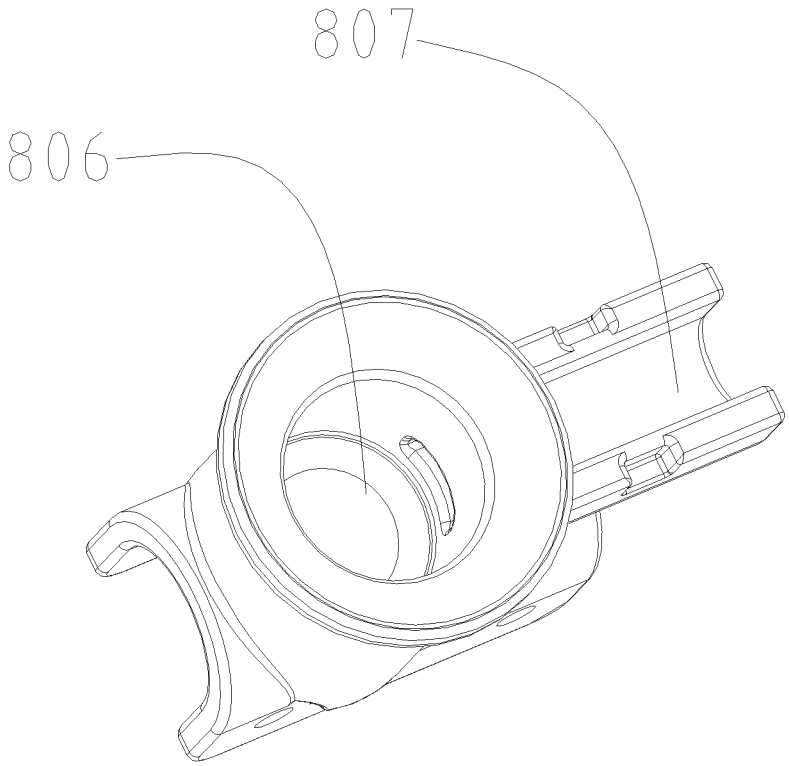
FIG. 6 is a structural diagram of a main body of a third connector of the embodiment of the folding chair according to the present application.
Figure 7:
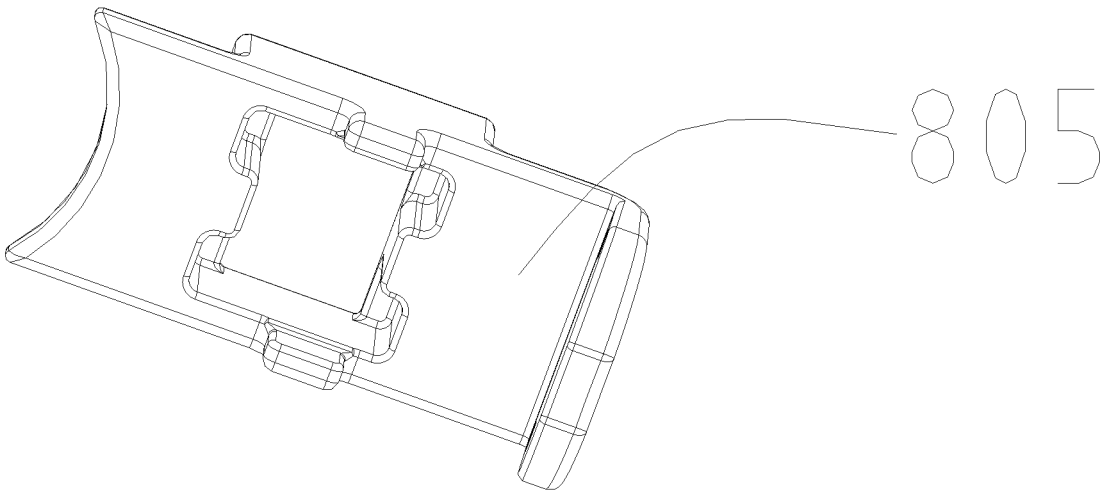
FIG. 7 is a structural diagram of a cover of the third connector of the embodiment of the folding chair according to the present application.

In this example, the linkage posts 2 each are fixed with a third connector 8. As shown in FIGS. 5 to 7, the third connector 8 includes main body 801, lock key 802, press key 803, spring 804, and cover 805. The main body 801 is fixed on the linkage post 2 and provided with second socket 806 and receiving slot 807. The lock key 802 is provided in the receiving slot 807 and includes a head inserted into the second socket 806 from a side. The cover 805 covers the receiving slot 807. The press key 803 is provided on the cover 805 and is in sliding fit with the cover 805. The lock key 802 includes post portion 808 connected to the head. The post portion 808 is provided thereon with retaining ring 809. The spring 804 is sleeved on the post portion 808 and includes two ends pressed against the retaining ring 809 and the cover 805, respectively. The lock key 802 is provided with first inclined plane 100, and the press key 803 is provided with second inclined plane 200 opposite to the first inclined plane 100. A lower end of each of the standing posts 1 is provided with a clamping opening.

The first connector 5 is slidably sleeved on the standing post 1. The lower end of the standing post 1 is inserted into the second socket 806. A force of the spring 804 makes the head of the lock key 802 embedded in the clamping opening to fix the standing post 1, thereby preventing the standing post 1 from separating from the second socket 806. When the press key 803 is pressed, the second inclined plane 200 presses the first inclined plane 100, causing the lock key 802 to move backward and further compress the spring 804. Thus, the head of the lock key 802 is separated from the clamping opening to pull the standing post 1 out of the second socket 806.

The folding chair further includes cushion 9. Two sides of the cushion 9 are respectively connected to hanging straps 10. The standing posts 1 are respectively connected to the hanging straps 10 through fourth connectors 11 to support the hanging straps 10. When the bottom support structure is unfolded and the standing post 1 is inserted into the second socket 806, the first connector 5 is slidable upward along the standing post 1, so it is hard to guarantee that the folding chair remains stable in the unfolded state. Therefore, the standing post 1 is further provided with pressing portion 12. In this example, the pressing portion 12 is a protruding portion on the standing post 1. If the lock key 802 is not provided, when a user sits on the cushion 9, the gravity borne by the cushion 9 is transferred to the standing post 1 through the hanging strap 10 and the fourth connector 11. Thus, the protruding portion firmly presses the first connector 5, such that the first connector 5 cannot move upward. If the lock key 802 is provided, the user can slightly press the standing post 1 when inserting the standing post 1 into the second socket 806. When the lock key 802 is embedded in the clamping opening, the protruding portion presses the first connector 5 to make it unable to move upward.

In other embodiments, the third connector 8 is omitted. The second connector 6 is provided with a first socket, and the lower end of the standing post 1 is inserted into the first socket. Alternatively, the third connector 8 and the second connector 6 are integral, and the standing post 1 inserted into the first socket is clamped by the lock key 802.

In other embodiments, the support base 7 is omitted. The diagonal bracing mechanisms each further include two base plates, the lower ends of the diagonal braces 3 are respectively hinged with the base plates, and the first ends of the under-frame posts 4 are respectively hinged with parts of the diagonal braces 3 close to the base plates.

Inspired by the above ideal embodiments of the present application, those skilled in the art can make various changes and modifications through the above description without departing from the scope of the technical idea of the present application. The technical scope of the present application is subject to the scope of the claims and is not limited to the content of the specification.

What is claimed is:

1. A folding chair, comprising two standing posts, two diagonal bracing mechanisms, and a linkage mechanism connected between the two diagonal bracing mechanisms, wherein the linkage mechanism comprises two linkage posts, wherein the two linkage posts are crossed and hinged with each other;

each of the two diagonal bracing mechanisms comprises two diagonal braces, two under-frame posts, a first connector, and a second connector, wherein upper ends of the two diagonal braces and an upper end of one linkage post are hinged with the first connector, and lower ends of the two diagonal braces are respectively hinged with first ends of the two under-frame posts; and second ends of the two under-frame posts and a lower end of the linkage post are hinged with the second connector;

the two standing posts are respectively connected to two first connectors and respectively limit positions of the two first connectors; and lower ends of the two standing posts are detachably fixed to the linkage mechanism or are respectively detachably fixed to the two diagonal bracing mechanisms.

2. The folding chair according to claim 1, further comprising two third connectors, wherein the two third connectors are respectively fixed to the two linkage posts, and each of the two third connectors is provided with a second socket; and the lower end of the standing post is inserted into the second socket.

3. The folding chair according to claim 2, wherein the first connector is slidably sleeved on the standing post.

4. The folding chair according to claim 3, wherein the standing post is provided with a pressing portion; and when the folding chair is unfolded, the pressing portion is configured to press the first connector.

5. The folding chair according to claim 4, wherein each of the two third connectors comprises a main body, a lock key, a press key, a spring, and a cover;

the main body is provided with the second socket and a receiving slot; the lock key is provided in the receiving slot; a head of the lock key is inserted into the second socket from a side; the cover covers the receiving slot; the press key is provided on the cover and is in sliding fit with the cover; the lock key comprises a post portion connected to the head; a retaining ring is provided on the post portion; and the spring is sleeved on the post portion; and two ends of the spring are pressed against the retaining ring and the cover, respectively;

the lock key is provided with a first inclined plane, and the press key is provided with a second inclined plane opposite to the first inclined plane; and the lower end of the standing post is provided with a clamping opening;

when the standing post is inserted into the second socket, the head of the lock key is embedded into the clamping opening; and when the press key is pressed, the second inclined plane presses the first inclined plane to separate the head of the lock key from the clamping opening.

6. The folding chair according to claim 5, wherein the folding chair further comprises a cushion; two sides of the cushion are respectively connected to hanging straps; and the standing posts are respectively connected to the hanging straps through fourth connectors to support the hanging straps.

7. The folding chair according to claim 6, wherein each of the two diagonal bracing mechanisms further comprises two support bases; and the lower ends of the two diagonal braces and the first ends of the two under-frame posts are respectively hinged with the two support bases.

8. The folding chair according to claim 6, wherein each of the two diagonal bracing mechanisms further comprises two base plates; the lower ends of the two diagonal braces are respectively hinged with the base plates; and the first ends of the two under-frame posts are respectively hinged with the two diagonal braces.

9. The folding chair according to claim 1, wherein the first connector is slidably sleeved on the standing post.

10. The folding chair according to claim 9, wherein the standing post is provided with a pressing portion; and when the folding chair is unfolded, the pressing portion is configured to press the first connector.

11. The folding chair according to claim 2, further comprising a cushion, wherein two sides of the cushion are respectively connected to hanging straps; and the standing posts are respectively connected to the hanging straps through fourth connectors to support the hanging straps.

12. The folding chair according to claim 11, wherein each of the two diagonal bracing mechanisms further comprises two support bases; and the lower ends of the two diagonal braces and the first ends of the two under-frame posts are respectively hinged with the two support bases.

13. The folding chair according to claim 11, wherein each of the two diagonal bracing mechanisms further comprises two base plates; the lower ends of the two diagonal braces are respectively hinged with the two base plates; and the first ends of the two under-frame posts are respectively hinged with the two diagonal braces.

* * * * *